United States Patent [19]

Lanfermann

[11] Patent Number: 4,478,457

[45] Date of Patent: Oct. 23, 1984

[54] LONGWALL MINING APPARATUS FOR WORKING THICK SEAMS

[75] Inventor: Willy Lanfermann, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 489,716

[22] Filed: Apr. 29, 1983

[30] Foreign Application Priority Data

May 15, 1982 [DE] Fed. Rep. of Germany ..... 3218495

[51] Int. Cl.[3] ..... E21C 25/16

[52] U.S. Cl. ..... 299/18; 299/46

[58] Field of Search ..... 299/18, 31, 43, 44, 299/45, 46, 53, 54, 71, 80

[56] References Cited

U.S. PATENT DOCUMENTS 3,979,151 9/1976 Plummer ..... 299/71 X 4,029,361 6/1977 Beckmann ..... 299/31

FOREIGN PATENT DOCUMENTS 2701886 7/1978 Fed. Rep. of Germany ..... 299/43

*Primary Examiner*—Ernest R. Purser

*Assistant Examiner*—Timothy David Hovis

*Attorney, Agent, or Firm*—Thomas H. Murray

[57] ABSTRACT

A longwall mining machine and method for its use, the machine traveling over a face conveyor having a first toothed rack extending therealong. A gantry-like frame is movable along the face conveyor and has upstanding supports at its opposite ends which carry an upper track and a second toothed rack. A first mining machine frame is carried on the face conveyor and has drive pinion means engageable with the first toothed rack. A second mining machine frame is carried on the upper track of the gantry-like frame and has drive pinion means engageable with the second toothed rack. The first and second mining machine frames each having a shearer drum mounted thereon for cutting and removing a mineral seam. Means are provided for selectively securing the first and second mining machine frames to the gantry-like frame, the arrangement being such that when the first and second machines are secured to the gantry-like frame, the entire frame with both mining machine frames will traverse the face conveyor upon rotation of the drive pinion means on the first mining machine. At the end of a face area being mined, the lower mining machine frame is moved to a position where it is directly beneath the upper mining machine frame.

8 Claims, 2 Drawing Figures

LONGWALL MINING APPARATUS FOR WORKING THICK SEAMS

BACKGROUND OF THE INVENTION

While not necessarily limited thereto, the present invention relates to longwall mining machinery for working thick seams in underground mining, and more particularly in pillar clearance or in driving large rise headings. In the past, systems such as that shown in German Offenlegungsschrift No. 2,509,810 have been provided in which both a bottom frame and a top frame extend along the longwall mining face. A face conveyor and a longwall mining machine are provided for both the bottom frame and the top frame of the system, the bottom machine removing the mineral seam down to the floor and the top machine removing the seam up to the roof, in each case through the agency of a shearer drum carried by a pivoted arm.

Facilities of the kind described above can be used only for longwall working and even in this connection only for relatively thick seams. Furthermore, they cannot be used to drive a large rise heading or to clear pillars. They are expensive to build and elaborate since they can be operated only with the two double drum-cutter loader machines which require clearance at both face ends beyond the end of the support system. An elaborate system of this type is uneconomical for driving large rise headings or clearing pillars, if for no other reason than the complex machinery needed for the facility.

SUMMARY OF THE INVENTION

In accordance with the present invention, mining machine apparatus is provided for removing coal or other mineral matter from relatively short and relatively thick seam portions at a reduced cost in construction and machinery. The invention employs a gantry-like frame movable along a face conveyor having a toothed rack extending therealong. The gantry frame has upstanding supports at its opposite ends which carry an upper track and an upper toothed rack. A first mining machine frame is carried on the face conveyor and has drive pinion means engageable with the first toothed rack. In a similar manner, a second mining machine frame is carried on the upper track of the gantry-like frame and is provided with drive pinion means engageable with the upper toothed rack. The second mining machine frame can reciprocate along the upper track independently of the first mining machine frame. Both frames are provided with a shearer drum mounted centrally on the frame by means of a pivoted arm. By securing the upper and lower mining machine frames to the gantry frame at opposite ends thereof, and by causing the lower machine frame to traverse the face conveyor by engagement of its pinion drive with the face conveyor toothed rack, the entire gantry frame and both machines carried thereby can be caused to traverse a longwall mining face. In this process, the shearer drum of the upper mining machine frame cuts the roof while the shearer drum on the bottom mining frame cuts the floor over the whole length of the face being mined.

At the end of the face, the bottom machine frame is disconnected from the gantry frame and moves within the gantry frame to the opposite end thereof directly beneath the upper mining machine frame. Thereafter, the pivotal arm on which the shearer drum of the lower machine is carried is caused to rotate into a position which is leading relative to the machine body, whereby the remaining, lower portion of the seam is removed. In order to reverse the direction of mining, the positions of the upper and lower mining machine frames on the gantry frame are simply reversed.

The gantry frame is preferably about twice as long as the upper and lower mining machine frames and is provided with means for locking it to the face conveyor, preferably means for locking it to the toothed rack extending along the face conveyor. As a result, the upper machine frame has adequate freedom of movement relative to the bottom machine frame and can be moved relative thereto in both directions of machine movement into a leading position in which the shearer drum of the upper machine cuts the top part of the seam and greatly reduces the stress on the bottom part of the seam.

Since thick seams tend to break out, the top mining machine frame is movable on a platform which can be pivoted by means of hydraulic cylinders around a face-side pivot or hinge which extends in the direction of machine movement. This platform enables the upper machine to be moved into an inclined position relative to the face, the machine now taking up a position in which its shearer drum penetrates deeper into the seam and cuts deeper into the roof face, a factor which considerably reduces the risk of break-out. When the upper machine is preferably in the form of a frustum of a cone such that its generatrix extends parallel to the roof, the shearer drum thus being able to make a clean clearing cut up to the roof surface.

The above and other objects and features of the invention will become apparent from the following detailed description taken in connection with the accompanying drawings which form a part of this specification, and in which.

Figure 1:
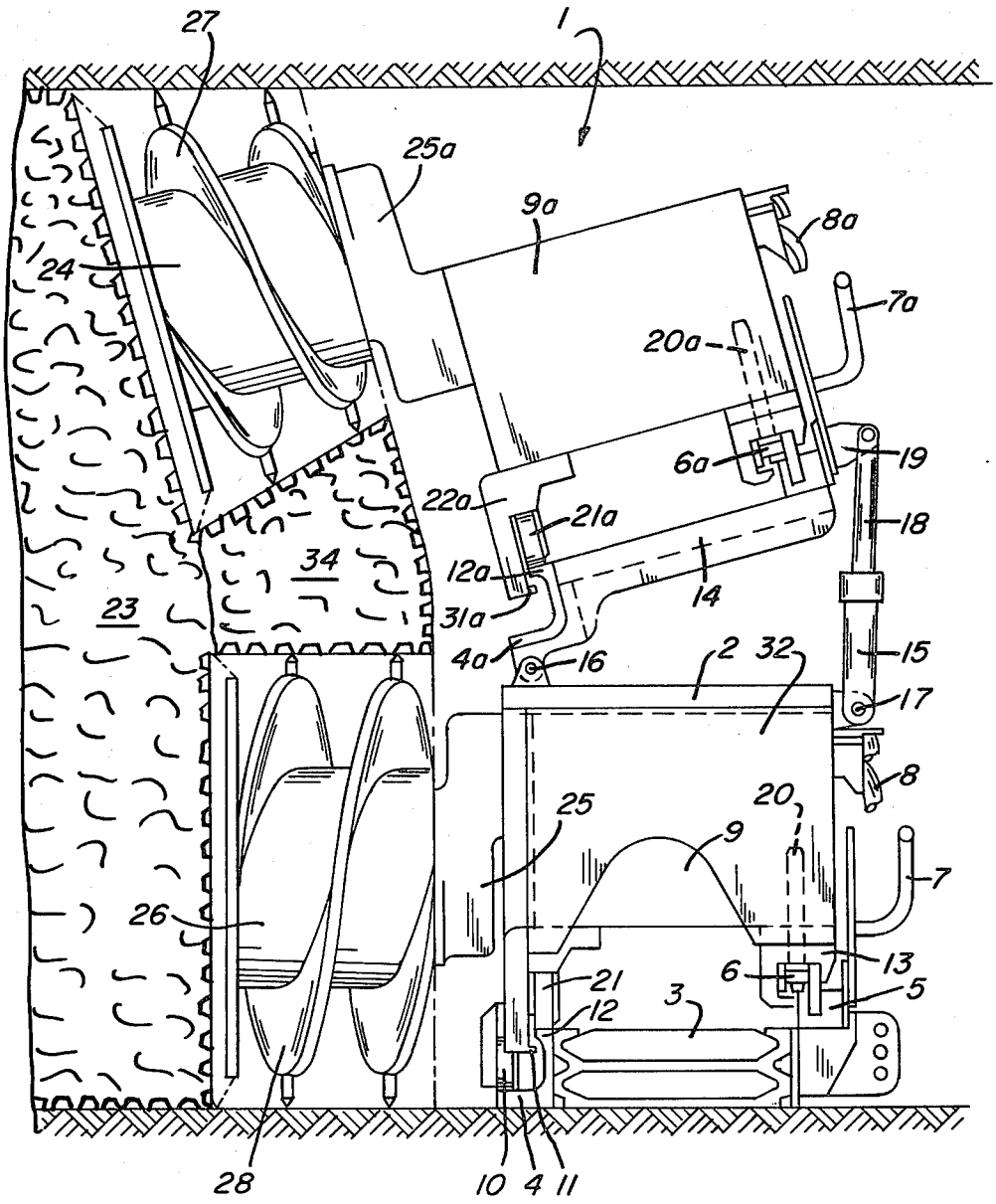
FIG. 1 is an end view of the mining machine apparatus of the invention.

With reference now to the drawings, there extends along a longwall face 23 a face conveyor 3 mounted on the face side by a machinc track 4 and by rack holders or blocks 5 on the stow side. Holders 5 support a toothed rack 6 which extends over the length of the face conveyor 3. Preferably, the toothed rack 6 is formed from interconnected sections.

The mining machine apparatus of the invention is identified generally by the reference numeral 1 and includes a gantry-like frame 2 mounted for movement above the face conveyor 3. In this respect, the gantry-like frame 2 bears on the machine track 4 on the face side by means of rollers 10. Projections 11 on the frame 2 extend below a shoulder 12 on the track 9 and prevent the frame 2 from tilting. The stow side of the frame 2 is guided by means of runners 13 (see also FIG. 2) adapted to slide along the rack 6. The runners 13, as shown in FIG. 1, straddle the rack and prevent the frame 2 and machine from tilting.

Figure 2:
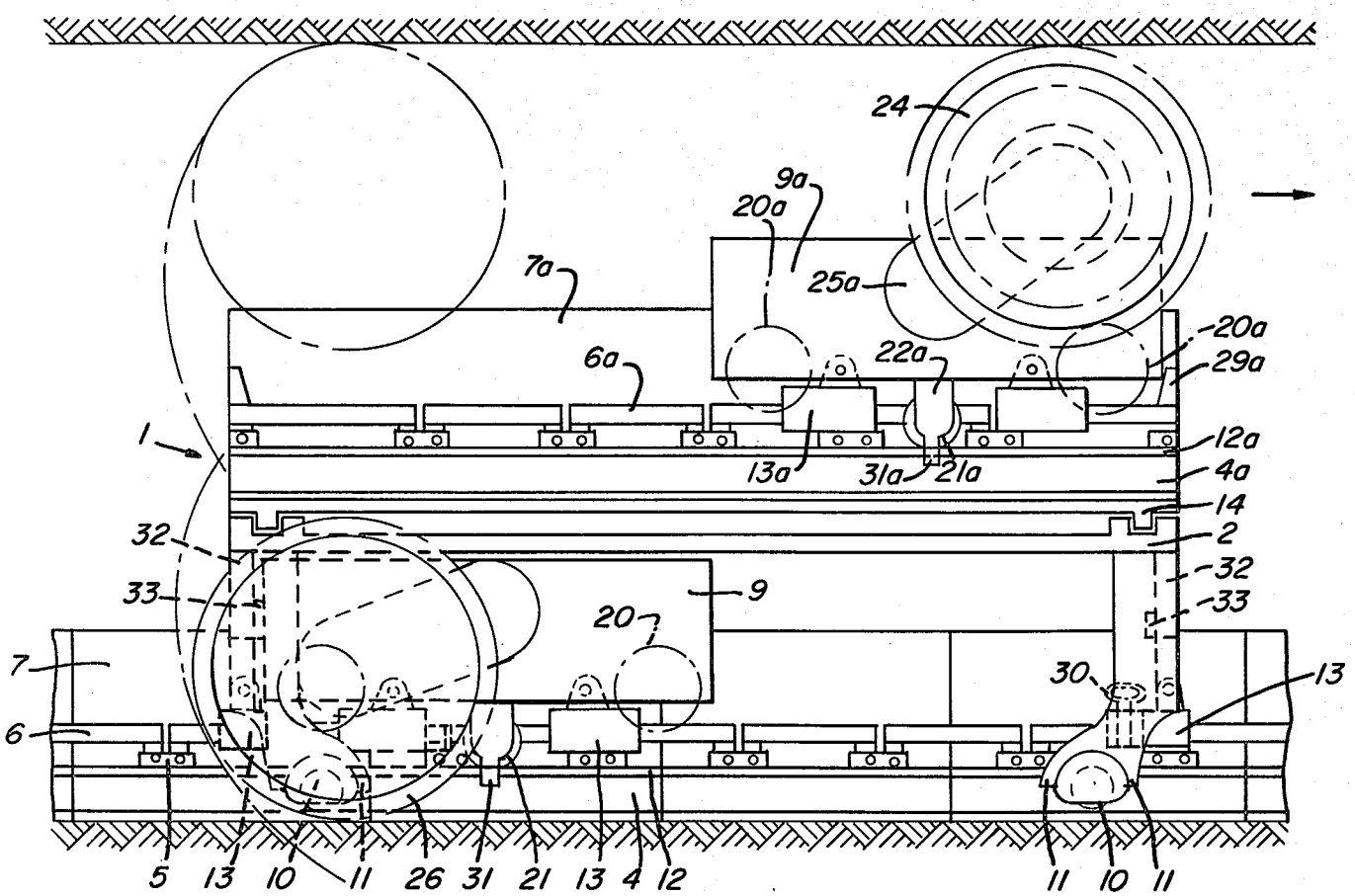
FIG. 2 is a front elevational view of the face side of the mining machine apparatus, the top mining machine being disposed horizontally in FIG. 2 rather than pivoted as shown in FIG. 1.

As shown in FIG. 2, the frame 2 has at its opposite ends upstanding supports 32 which carry an upper platform 14 pivoted to the frame 2 about hinges or pivots 16 on the face side of the machine. The platform 14 is provided on its stow side with brackets 19 connected to piston rods 18 of cylinders 15. Cylinders 15, in turn, are connected to the frame 2 by means of clevises 17. In this manner, the cylinders 15 can pivot the platform 14 about the hinges or pivots 16 into a tilted position such as that shown in FIG. 1. The upper platform 14 carries a machine track 4a corresponding to the lower machine track 4 on the face side and, similarly, carries a toothed rack 6a on the stow side, corresponding to the lower rack 6 on the face conveyor 3.

Carried on the lower machine track 4 by means of roller 21 is a lower mining machine frame 9. Similarly, an upper mining machine frame 9a is carried on the track 4a by means of roller 21a carried on bracket 22a. The lower machine 9 is provided with drive pinion means 20 engageable with the rack 6 on the face conveyor 3. Similarly, the upper mining machine 9a is provided with drive pinion means 20a engageable with the rack 6a carried on the platform 14. As is the case with the lower machine, the upper machine 9a moves along the machine track 4a by means of roller 21a. Like the gantry frame 2, the machine 9a is provided with a projection 31a on bracket 22a beneath a flange on a track shoulder 12a. It is also provided with runners 13a on the stow side which envelop the rack 6a so as to prevent the upper machine 9a from tilting.

As shown in FIG. 1, the platform 14 can be tilted by means of the cylinders 15 to move the machine 9a into a position in which it cuts deeper into the seam 23. Each mining machine 9 or 9a is provided with a pivoted arm 25 or 25a which carries a shearer drum 24 or 26. Each shearer drum, in turn, is provided with spiral convolutions 27 or 28 which direct the material being mined onto the face conveyor 3. The shearer drum 24 for the upper machine 9a narrows in diameter toward the machine 9a. This narrowing has an inclination corresponding to the inclination of the platform 14 such that straight-line contact with the mine roof is effected, insuring that the roof will be cut clear. Except for the two drums 24 and 26, the two machines 9 and 9a are identical. Their respective pivoted arms 25 and 25a can pivot through a complete circle. The two machines 9 and 9a can move on their respective tracks 4 and 4a independently of each other. In this respect, each machine is provided with drive pinions 20 or 20a which engage the racks 6 or 6a. Upon rotation of the toothed drive pinion on either machine, it will move its associated machine along its associated rack 6 or 6a. As will be appreciated, the upper machine 9a removes mined material from the upper portion of the seam; whereas the lower machine 9 removes mined material down to the floor of the seam. Any strip 34 of the seam remaining between the two shearer drums 26 and 24 breaks and is discharged toward the face conveyor 3 with the mined material by means of the convolutions on the shearer drums 24 and 26. Power is supplied to the two machines 9 and 9a by means of cables 8 or 8a which rest on side brackets 7 and 7a as the machines advance.

As can be seen from FIG. 2, the gantry-like frame 2 is approximately twice as long as the machine body of a single mining machine 9 or 9a. The lower and upper racks 6 and 6a have end stops which prevent the machines from moving beyond the gantry-like frame 2. The end stops for the upper rack 6a are identified by the reference numeral 29a; however the stops for the lower machine 9 are not visible in the drawings.

The gantry-like frame 2 has locking means 30 (FIG. 2) for securing it to the rack 6 of the face conveyor 3. In the usual case, the frame 2 is secured to the lower rack 6 as the top machine 9a moves along the track 4a while it is shearing mined material. That is, the locking means 30 prevent the frame 2 from moving while the upper machine 9a moves along the track 4a to cut the seam. The rollers 10 and runners 13 are inboard of the ends of the frame 2 as shown in FIG. 2 but are nevertheless in the cutting zone of the bottom shearer drum 26. To improve the discharge of mined material onto the face conveyor 3, there is provided on the face side of each machine 9 or 9a a single roller 21 or 21a which is disposed centrally on each machine between the two stow side drive pinions 20 or 20a. Couplings 33 on the two upstanding supports 32 near the ends of the gantry-like frame 2 are provided for connecting the bottom machine 9 to the gantry frame.

Before an actual shearing operation begins, the frame 2 is secured to the face conveyor 3 by engaging the locking means 30 thereon with the lower rack 6. The bottom machine 9 is then moved into the position shown in FIG. 2 where it is at the left end of the frame 2 and is locked in this position by means of the coupling 33 on the left end of the frame 2 (FIG. 2). The drum 26 of the lower machine 9 takes up the trailing position shown in FIG. 2 where it cuts the seam clear at the rearward end of the frame 2 and clears the floor. This assumes that the machine is traveling from left to right as indicated by the arrow shown in FIG. 2. Again, before the shearing operation begins, the top machine 9a is moved to the right end of the frame 2 and is locked in this position by locking its drive pinion wheels 20a. Consequently, neither machine 9 or 9a can now move relative to the frame 2. The shearer drum 24 of the upper machine 9a is swung into the position shown in FIG. 2 where it leads the frame 2 and engages the face and cuts clear the roof area of the seam 23.

In the subsequent winning or mining operation, the apparatus 1 is moved to the right as shown in FIG. 2 solely by the two drive pinions 20 on the bottom machine 9. In this process, the top machine 9a moves together with the bottom machine 9 and the frame 2 to which it is locked, the top shearer drum 24 cutting the roof and the bottom shearer drum 26 the floor over the whole length of the face. As was mentioned above, any strip 34 of seam remaining between the two shearer drums 24 and 26 breaks in and is discharged with the other mined material by the spiral convolutions 27 and 28 on the two shearer drums 24 and 26. In this process,- the mined material is fed toward the face conveyor 3 where it is conveyed toward the end of the face area being mined.

When the frame 2 carrying the machines 9 and 9a reaches the end of the face area being mined, the coupling 33 is released. Rotation of the drive pinions 20 on the lower machine 9 now causes it to traverse the frame from left to right such that it assumes a position directly beneath the upper machine 9a; whereas the pivotal arm 25 for machine 9 is rotated to bring the shearer drum 26 of the lower machine into a position which is leading relative to the frame 2. At this point, the entire upper and lower portions of the face have been removed to the end of the face area. At this point, the lower machine 9 is again locked to the frame by means of the coupling 33 on the right upstanding supports 32.

The apparatus 1 can now move into the roadway at the end of the face area with its leading shearer drums 24 and 26. The apparatus 1 is then advanced toward the face of the seam 23 together with the face conveyor 3 such that the two shearer drums 24 and 26 are now in position to begin a cut along the face area in the opposite direction. At this point, the frame 2 is again secured to the toothed rack 6 by means of the locking means 30; and the top machine 9*a* is moved from right to left as viewed in FIG. 2 such that its position is reversed and its shearer drum 24 is in a leading position relative to the frame. Again the upper machine 9*a* is locked to the upper rack 6*a* by locking its drive pinions 20*a*. The apparatus 1 is now ready for a winning or mining operation in the opposite direction (i.e., from right to left as viewed in FIG. 2) with the upper shearer drum 24 leading and the lower shearer drum 26 trailing.

If the apparatus 1 must be sumped into a new face area to be mined, the two machines 9 and 9*a* have their shearer drums 24 and 26 disposed one above the other at the face end. Under these circumstances, the bottom machine 9 is initially connected to the frame 2, whereupon the machine 9 moves the complete apparatus along the already-advanced part of the face conveyor 3 and thus brings the apparatus 1 into a position in which the two shearer drums 24 and 26 are disposed in the new face. After the unadvanced central portion of the face conveyor 3 has been advanced, the apparatus 1 is returned to the face end; whereupon the top machine 9*a* is moved into a leading position at the opposite end of the frame 2. After the arm 25*a* has pivoted to bring the shearer drum 24 of the top machine 9*a* to a position where it is in front of the machine body or frame end face, the new mining machine movement can begin.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A longwall mining machine which travels over a face conveyor having a first toothed rack extending therealong, comprising a gantry-like frame movable along said face conveyor, said gantry-like frame having upstanding supports at its opposite ends which carry an upper track and a second toothed rack, a first mining machine frame carried on said face conveyor and having drive pinion means engageable with said first toothed rack, a second mining machine frame carried on said upper track on the gantry-like frame and having drive pinion means engageable with said second toothed rack, said second mining machine frame being reciprocable along said upper track independently of said first mining machine frame, said first and second mining machine frames each having a shearer drum mounted thereon for cutting and removing a mineral seam, and means for selectively securing said first and second mining machine frames to said gantry-like frame, the arrangement being such that when the first and second machines are secured to the gantry-like frame, the entire gantry-like frame and both mining machine frames will traverse said face conveyor upon rotation of the drive pinion means on the first mining machine.

2. The mining machine of claim 1 wherein the gantry-like frame is approximately twice as long as said first and second mining machine frames, and means for selectively securing said gantry-like frame to said face conveyor.

3. The mining machine of claim 1 wherein said first toothed rack extends along one side of said face conveyor and the machine track extends along the other side of the face conveyor, said gantry-like frame being provided with roller means which traverses said machine track on one side of the face conveyor, the frame resting on the other side of said track on said toothed rack.

4. The mining machine of claim 1 wherein said upper track and said second toothed rack are mounted on a platform pivotally connected to the face side of said gantry-like frame about a pivot axis extending parallel to said face conveyor, and hydraulic cylinder means for tilting said platform, said upper track, said second toothed rack and the second mining machine frame carried thereby.

5. The mining machine of claim 4 wherein the shearer drum mounted on said second mining machine frame is in the form of a frustum of a cone such that when said platform is pivoted about its connection to the gantry-like frame, the peripheral surface of the shearer drum will make line contact with the top of a mineral seam along a line which is perpendicular to the direction of said mining machine along the face conveyor.

6. The mining machine of claim 1 wherein said shearer drums are carried by said first and second mining machine frames on pivotal arms.

7. The mining machine of claim 1 including means for securing said gantry-like frame to said face conveyor when said second mining machine frame traverses said upper track while its shearer drum removes material from said seam.

8. A method for operating longwall mining machine apparatus of the type having a gantry-like frame movable along the machine track of a face conveyor, said gantry-like frame carrying an upper second machine track, and upper and lower mining machines carried on said upper second machine track and said face conveyor machine track respectively, with each of said mining machines being provided with a shearer drum carried on a pivotal arm, said method comprising:

securing said gantry-like frame to said face conveyor, moving said upper and lower mining machines to opposite ends of said gantry-like frame and positioning said shearer drums on their pivotal arms at positions where the upper pivotal arm is inclined upwardly and toward one end of the gantry-like frame while the lower pivotal arm is inclined downwardly and toward the other end of the gantry-like frame, securing said upper and lower mining machines to said gantry-like frame, releasing the gantry-like frame from said face conveyor and causing said lower mining machine to traverse the face conveyor while carrying said gantry-like frame and said upper mining machine therewith while said shearer drums cut and remove material from a face being mined, and when said gantry-like frame reaches the end of a face area being mined, again securing said gantry-like frame to said face conveyor while causing said lower mining machine to traverse the gantry-like frame to a position where it is directly below the upper mining machine.

* * * * *